US007802658B2

(12) United States Patent
Aulanko et al.

(10) Patent No.: US 7,802,658 B2
(45) Date of Patent: Sep. 28, 2010

(54) ELEVATOR CABLE TENSIONING DEVICE

(75) Inventors: Esko Aulanko, Kerava (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/106,631

(22) Filed: Apr. 15, 2005

(65) Prior Publication Data

US 2005/0217944 A1 Oct. 6, 2005

Related U.S. Application Data

(63) Continuation of application No. PCT/FI03/00817, filed on Nov. 4, 2003.

(30) Foreign Application Priority Data

Nov. 4, 2002 (FI) ..... 20021959
Jan. 31, 2003 (FI) ..... 20030153
Oct. 1, 2003 (WO) ..... PCT/FI03/00714

(51) Int. Cl.
*B66B 11/08* (2006.01)

(52) U.S. Cl. ..... 187/266; 187/406; 187/900

(58) Field of Classification Search ..... 187/266, 187/406, 900
See application file for complete search history.

(56) References Cited

U.S. PATENT DOCUMENTS 216,568 A * 6/1879 Holske ..... 187/251
998,629 A 7/1911 Neenan
3,838,752 A 10/1974 Berkovitz
4,624,097 A * 11/1986 Wilcox ..... 57/232
5,014,822 A * 5/1991 Chapelain et al. ..... 187/408
5,065,843 A * 11/1991 Richards ..... 187/408
5,398,781 A * 3/1995 Biewald et al. ..... 187/264
5,429,211 A * 7/1995 Aulanko et al. ..... 187/254
6,193,017 B1 * 2/2001 Koster ..... 187/258

(Continued)

FOREIGN PATENT DOCUMENTS

EP 1 213 250 A1 6/2002

(Continued)

OTHER PUBLICATIONS

International Search Report & International Preliminary Examination Report.

(Continued)

*Primary Examiner*—Evan H Langdon
(74) *Attorney, Agent, or Firm*—Harness, Dickey & Pierce, P.L.C.

(57) ABSTRACT

An elevator may include an elevator car, two or more diverting pulleys on the elevator car, one or more hoisting ropes, a traction sheave, and a compensating device. The hoisting ropes may include first, second, third, and fourth rope portions. The first rope portions may extend upward from at least one diverting pulley and the second rope portions may extend downward from at least one diverting pulley. The first rope portions may be under a first tension caused by the compensating device acting on the third rope portion and the second rope portions may be under a second tension caused by the compensating device acting on the fourth rope portion. The first tension to the second rope tension may be maintained substantially constant and may be independent of a load of the elevator.

23 Claims, 11 Drawing Sheets

U.S. PATENT DOCUMENTS

| | | | | |
|---|---|---|---|---|
| 6,199,666 | B1 * | 3/2001 | Aulanko et al. | 187/277 |
| 6,364,067 | B1 * | 4/2002 | Glassey et al. | 187/408 |
| 6,401,871 | B2 * | 6/2002 | Baranda et al. | 187/254 |
| 2005/0150728 | A1 * | 7/2005 | Van Der Meijden et al. | 187/411 |
| 2005/0224301 | A1 * | 10/2005 | Aulanko et al. | 187/406 |

FOREIGN PATENT DOCUMENTS

| | | | |
|---|---|---|---|
| EP | 1213250 | A1 * | 6/2002 |
| JP | 1994-080347 | A | 3/1994 |
| JP | 1998-159372 | A | 6/1998 |
| JP | 2002-173281 | A | 6/2002 |
| JP | 2002-275773 | A | 9/2002 |
| WO | WO 01/21522 | A1 | 3/2001 |
| WO | WO 02/46086 | A1 | 6/2002 |

OTHER PUBLICATIONS

Translation of Japanese Office Action mailed Jan. 13, 2009, for Japanese Patent Application No. JP 2005-502117 A.

* cited by examiner

ELEVATOR CABLE TENSIONING DEVICE

This application is a continuation of, and claims priority under 35 U.S.C. §120 and 35 U.S.C. §365(c) from, PCT International Application No. PCT/FI2003/000817 which has an International filing date of Nov. 4, 2003, which designated the United States of America, PCT International Application No. PCT/FI03/00714, which has an International filing date of Oct. 1, 2003, FINLAND Application Priority Number 20030153 filed Jan. 31, 2003 and FINLAND Application Priority Number 20021959 filed Nov. 4, 2002 the entire contents of all of which are hereby incorporated herein by reference.

Example embodiments relate to elevators and methods for forming elevators.

BACKGROUND

One of the objectives in elevator development work is to achieve efficient and economical utilization of building space. In recent years, this development work has produced various elevator solutions without machine room, among other things. Good examples of elevators without machine room are disclosed in specifications EP 0 631 967 (A1) and EP 0 631 968. The elevators described in these specifications are fairly efficient in respect of space utilization as they have made it possible to eliminate the space required by the elevator machine room in the building without a need to enlarge the elevator shaft. In the elevators disclosed in these specifications, the machine is compact at least in one direction, but in other directions it may have much larger dimensions than a conventional elevator machine.

In these basically good elevator solutions, the space required by the hoisting machine limits the freedom of choice in elevator lay-out solutions. Space is needed for the arrangements required for the passage of the hoisting ropes. It is difficult to reduce the space required by the elevator car itself on its track and likewise the space required by the counterweight, at least at a reasonable cost and without impairing elevator performance and operational quality. In a traction sheave elevator without machine room, mounting the hoisting machine in the elevator shaft is often difficult, especially in a solution with machine above, because the hoisting machine is a sizeable body of considerable weight. Especially in the case of larger loads, speeds and/or hoisting heights, the size and weight of the machine are a problem regarding installation, even so much so that the required machine size and weight have in practice limited the sphere of application of the concept of elevator without machine room or at least retarded the introduction of said concept in larger elevators. In modernization of elevators, the space available in the elevator shaft often limits the area of application of the concept of elevator without machine room. In many cases, especially when hydraulic elevators are to be modernized or replaced, it is not practical to apply the concept of roped elevator without machine room due to insufficient space in the shaft, especially in a case where the hydraulic elevator solution to be modernized/replaced has no counterweight. A disadvantage with elevators provided with a counterweight is the cost of the counterweight and the space it requires in the shaft. Drum elevators, which are nowadays rarely used, have the drawbacks of heavy and complex hoisting machines with a high power/torque requirement. Prior-art elevator solutions without counterweight are exotic, and no adequate solutions are known. Before, it has not been technically or economically reasonable to make elevators without a counterweight. One solution of this type is disclosed in specification WO9806655. A recent elevator solution without counterweight presents a viable solution. In prior-art elevator solutions without counterweight, the tensioning of the hoisting rope is implemented using a weight or spring, and this is not an attractive approach to implementing the tensioning of the hoisting rope. Another problem with elevator solutions without counterweight, when long ropes are used e.g. due to a large hoisting height or a large rope length required by high suspension ratios, is the compensation of the elongation of the ropes and the fact that, due to rope elongation, the friction between the traction sheave and the hoisting ropes is insufficient for the operation of the elevator. In a hydraulic elevator, especially a hydraulic elevator with lifting force applied from below, the shaft efficiency, in other words the ratio of the cross-sectional shaft area occupied by the elevator car to the total cross-sectional area of the elevator shaft, is fairly high. This has traditionally been a significant factor contributing towards the choice of a hydraulic elevator as the elevator solution for a building. On the other hand, hydraulic elevators have many drawbacks associated with their lifting mechanism and oil consumption. Hydraulic elevators consume plenty of energy, possible oil leakages from the elevator equipment is an environmental risk, the required periodic oil changes constitute a large cost item, even an elevator installation in good repair produces unpleasant smell as small amounts of oil escape into the elevator shaft or machine room and from there further into other parts of the building and into the environment and so on. Because of the shaft efficiency of the hydraulic elevator, its modernization by replacement with another type of elevator that would obviate the drawbacks of a hydraulic elevator while necessarily involving the use of a smaller elevator car is not an attractive solution to the owner of the elevator. Also, the small machine spaces of hydraulic elevators, which may be located at a large distance from the elevator shaft, make it difficult to change the elevator type.

There are a very large number of traction sheave elevators installed and in use. Such traction sheave elevators were built in their time in accordance with the users' needs as conceived at the time and the intended uses of the buildings in question. Afterwards, both users' needs and the uses of the buildings have changed in many cases, and an old traction sheave elevator may have proved to be insufficient in respect of car size or otherwise. For examples older and relatively small elevators are not necessarily suited for the transportation of prams or wheelchairs. On the other hand, in older buildings which have been converted from residential use for office or other uses, a smaller elevator installed in its time is no longer sufficient in respect of capacity. As is known, enlarging such a traction sheave elevator is practically impossible because the elevator car and the counterweight already take up the cross-sectional area of the elevator shaft and there is no reasonable way of enlarging the car.

SUMMARY

The object of the invention in general is to achieve at least one of the following objectives. On the one hand, it is an aim the invention to develop the elevator without machine room further so as to allow more effective space utilization in the building and elevator shaft than before. This means that the elevator must be so constructed that it can be installed in a fairly narrow elevator shaft if necessary. One objective is to achieve an elevator in which the hoisting rope has a good grip/contact on the traction sheave. Yet another objective is to achieve an elevator solution without counterweight without compromising the properties of the elevator. A further objective is to eliminate the adverse effects of rope elongations. It is an objective of the invention to create a method for replacing or modernizing a hydraulic elevator with/into a rope-driven elevator without reducing or at least without substantially reducing the size of the elevator car. It is an objective of the invention to enable a rope-driven elevator to be modernized into an elevator with a clearly larger car or to be replaced with an elevator with a larger car than before.

The object of the invention should be achieved without compromising the possibility of varying the basic elevator layout.

Example embodiments may be characterized by what is disclosed in the claims. Inventive embodiments may also be discussed in the description section of the present application. The inventive content of the application may also be defined differently than in the claims. The inventive content may also consist of several separate inventions, especially if the invention is considered in the light of expressions or implicit subtasks or from the point of view of advantages or categories of advantages achieved. Therefore, some of the attributes contained in the claims below may be superfluous from the point of view of separate inventive concepts. For example, the equipment comprising the main components of the elevator to be installed in place of the earlier elevator, or the equipment designed for modernization of the hoisting system of the earlier elevator, the equipment comprising the machinery, ropes and diverting pulleys needed for the hoisting function and accessories for the installation of these, and possibly also the elevator car and guide rails, may be an inventive whole together with an instruction to replace or alter the elevator at least in respect of the hoisting function so as to make it consistent with the present application.

By applying the invention, one or more of the following advantages, among others, can be achieved:

- Due to a small traction sheave, an elevator and/or elevator machine of a fairly compact size are/is achieved
- A good traction sheave grip, which is achieved in particular by using Double Wrap roping, and light-weight components allow the weight of the elevator car to be considerably reduced.
- A compact machine size and thin, substantially round ropes permit the elevator machine to be relatively freely placed in the shaft. Thus, the elevator solution of the invention can be implemented in a fairly wide variety of ways in the case of both elevators with machine above and elevators with machine below.
- The elevator machine can be advantageously placed between the car and a shaft wall.
- All or at least part of the weight of the elevator car can be carried by the elevator guide rails.
- Applying the invention allows effective utilization of the cross-sectional area of the shaft. Thus, e.g. a hydraulic elevator can be modernized into a rope-driven elevator or replaced in the same shaft with a rope-driven elevator without reducing the size of the elevator car, or an old traction sheave elevator can be replaced with or modernized into a larger elevator.
- The light, thin ropes are easy to handle, allowing considerably faster installation.
- For example, in elevators for a nominal load below 1000 kg, the thin and strong steel wire ropes of the invention have a diameter on the order of only 3-5 mm, although thinner and thicker ropes may also be used. As would be understood by one of ordinary skill in the art, the recitation "nominal load" is synonymous with the recitation "maximum working load." Additionally, one of ordinary skill in the art would understand the recitations "working load" as referring to a load carrying capacity of the elevator car (including the weight of passengers and/or freight, but not the elevator car itself), and "maximum working load" as referring to a single value representing the maximum load carrying capacity of the elevator car (including the weight of passengers and/or freight, but not the elevator car itself).
- With rope diameters of about 6 mm or 8 mm, fairly large and fast elevators according to the invention can be achieved.
- Either coated or uncoated ropes can be used.
- The use of a small traction sheave makes it possible to use a smaller elevator drive motor, which means a reduction in drive motor acquisition/manufacturing costs.
- The invention can be applied in gearless and geared elevator motor solutions.
- Although the invention is primarily intended for use in elevators without machine room, it can also be applied in elevators with machine room.
- In the invention, a better grip and a better contact between the hoisting ropes and the traction sheave are achieved by increasing the contact angle between them.
- Due to the improved grip, the size and weight of the car can be reduced.
- The space saving potential of the elevator of the invention is increased considerably as the space required by the counterweight is at least partially eliminated.
- As a result of the lighter and smaller elevator system, energy savings and at the same time cost savings are achieved.
- The placement of the machine in the shaft can be relatively freely chosen as the space required by the counterweight and counterweight guide rails and roping can be used for other purposes
- By mounting at least the elevator hoisting machine, the traction sheave and a rope sheave functioning as a diverting pulley in a complete unit, which is fitted as a part of the elevator of the invention, considerable savings in installation time and costs will be achieved.
- In the elevator solution of the invention, it is possible to dispose all ropes in the shaft on one side of the elevator car; for example, in the case of rucksack type solutions, the ropes can be arranged to run behind the elevator car in the space between the elevator car and the back wall of the elevator shaft.
- The invention makes it easy to implement scenic-type elevator solutions as well.
- Since the elevator solution of the invention does not necessarily comprise a counterweight, it is possible to implement elevator solutions in which the elevator car has doors in several walls, in an extreme case even in all the walls of the elevator car. In this case, the car guide rails of the elevator are disposed at the corners of the elevator car.
- The elevator solution of the invention can be implemented with several different machine solutions.
- The suspension of the car can be implemented using almost any suitable suspension ratio.
- Compensation of rope elongations by means of a compensating system according to the invention is a cheap and simple structure to implement.
- Compensation of rope elongations by means of a lever is a cheap and light structure.
- Using the rope elongation compensation solutions of the invention, it is possible to achieve a constant ratio between the forces $T_1/T_2$ acting on the traction sheave.
- The ratio between the forces $T_1/T_2$ acting on the traction sheave is independent of the load.

By using the rope elongation compensating system of the invention, unnecessary stress on the machine and ropes can be avoided.

By using the rope elongation compensating solutions of the invention, the relation between the forces $T_1/T_2$ can be optimized to achieve a desired value.

The solutions of the invention for compensating rope elongation are safe solutions which make it possible to guarantee the required friction/contact between the traction sheave and the hoisting rope in all situations.

In addition, the rope elongation compensating solutions of the invention make it unnecessary to stress the hoisting ropes in order to ensure friction between the traction sheave and the hoisting rope by loads larger than necessary, and consequently the useful life of the hoisting ropes is increased and their damage susceptibility is reduced.

When rope elongation is compensated using the arrangement of the invention for compensating rope elongation with compensating sheaves of different diameters, it will be possible using this solution to compensate even very large rope elongations, depending on the diameters of the pulleys used.

By using a rope elongation compensating solution according to the invention in which the compensating apparatus used is a differential gear, it is possible to compensate even large rope elongations, especially in the case of high hoisting heights.

The primary area of application of the invention is elevators designed for the transportation of people and/or freight. A typical area of application of the invention is in elevators whose speed range is about 1.0 m/s or below but may also be higher. For example, an elevator having a traveling speed of 0.6 m/s is easy to implement according to the invention.

In both passenger and freight elevators, many of the advantages achieved through the invention are pronouncedly brought out even in elevators for only 2-4 people, and distinctly already in elevators for 6-8 people (500-630 kg).

According to the invention, when an elevator, e.g. a hydraulic elevator or traction sheave elevator, is to be modernized or replaced, the existing elevator is removed partly or completely and a new elevator is formed, wherein the elevator car is suspended on a set of continuous hoisting ropes comprising rope portions going upwards from the elevator car and downwards from the elevator car. The new elevator to be set up is a traction sheave elevator, which is preferably implemented completely without counterweight. The old hoisting function is always removed from service, preferably also removed physically, which means that, for example in the case of a hydraulic elevator, the hydraulic cylinder and hydraulic machine are removed from the elevator or that, in the case of a traction sheave elevator, the old hoisting ropes, hoisting machine and counterweight are removed. The same elevator car or an enlarged or new elevator car is suspended on a new set of hoisting ropes, which can be installed while the old hoisting function is being removed or as a separate installation operation. A hydraulic elevator lifted from below or a corresponding hydraulic elevator can be easily converted into a roped elevator without having to reduce the size of the elevator car. When a so-called roped hydraulic elevator is to be replaced or modernized, the invention makes it possible to use a somewhat larger elevator car because, instead of a hydraulic cylinder placed at the side of the elevator car, only a space for the hoisting ropes is needed. When a traction sheave elevator is to be modernized or replaced, the invention already allows a clearly larger elevator car to be used, because the share of the shaft width required for the counterweight and counterweight guide rails, either laterally or towards the back wall, becomes available for accommodating a larger elevator car. Thus, for example, an elevator for 6 persons can be replaced with an elevator for 8 persons, or an elevator for 8 persons can be replaced with an elevator for 10 persons. The invention is also applicable for use in connection with larger elevators, although the most suitable range of application is elevators conventionally used in residential and office buildings, i.e. elevators designed for a nominal load of about 1000 kg or less. The elevator modernization or "full replacement" according to the invention is accomplished by replacing or modernizing an elevator installed in an elevator shaft or equivalent, e.g. in a partially open space located at the side of a building yet delimiting the elevator in respect of placement. In general, modernization primarily means modernizing the hoisting function and secondarily increasing the car size. The motive for modernization may consist of one or both of the above-mentioned reasons or some other reason. When an elevator is to be replaced, generally the car and the hoisting function are replaced. Heavy modernization of an elevator system or nearly complete replacement of the old elevator system are in many cases mutually alternative due to economic factors.

In the elevator of the invention, normal elevator hoisting ropes, such as generally used steel wire ropes, are applicable. In the elevator, it is possible to use ropes made of artificial materials and ropes in which the load-bearing part is made of artificial fiber, such as e.g. so-called "aramid ropes", which have recently been proposed for use in elevators. Applicable solutions also include steel-reinforced flat ropes, especially because they allow a small deflection radius. Particularly well applicable in the elevator of the invention are elevator hoisting ropes twisted e.g. from round and strong wires. From round wires, the rope can be twisted in many ways using wires of different or equal thickness. In ropes well applicable in the invention, the wire thickness is below 0.4 mm on an average. Well applicable ropes made from strong wires are those in which the average wire thickness is below 0.3 mm or even below 0.2 mm. For instance, thin-wired and strong 4 mm ropes can be twisted relatively economically from wires such that the mean wire thickness in the finished rope is in the range of 0.15 . . . 0.25 mm, while the thinnest wires may have a thickness as small as only about 0.1 mm. Thin rope wires can easily be made very strong. In the invention, rope wires having a strength greater than about 2000 $N/mm^2$ can be used. A suitable range of rope wire strength is 2300-2700 $N/mm^2$. In principle, it is possible to use rope wires having a strength of up to about 3000 $N/mm^2$ or even more.

The elevator of the invention, in which the elevator car is suspended by means of hoisting ropes consisting of a single rope or a number of parallel ropes, said elevator having a traction sheave which moves the elevator car by means of the hoisting ropes, has rope portions of the hoisting ropes going upwards and downwards from the elevator car, and the rope portions going upwards from the elevator car are under a first rope tension ($T_1$) which is greater than a second rope tension ($T_2$), which is the rope tension of the rope portions going downwards from the elevator car. In addition, the elevator comprises a compensating system for keeping the ratio ($T_1/T_2$) between the first rope tension and the second rope tension substantially constant.

In the method of the invention for forming an elevator, the elevator car is connected to the elevator roping used to hoist the elevator car, said roping consisting of a single rope or a plurality of parallel ropes and comprising rope portions going upwards and downwards from the elevator car, and that the elevator roping is provided with a compensating system for keeping the ratio ($T_1/T_2$) between the rope forces acting in upward and downward directions substantially constant.

By increasing the contact angle by means of a rope sheave functioning as a diverting pulley, the grip between the traction sheave and the hoisting ropes can be increased. In this way, the car can be made lighter and its size can be reduced, thus increasing the space saving potential of the elevator. A contact angle of over 180° between the traction sheave and the hoisting rope is achieved by using one or more diverting pulleys. The need to compensate the rope elongation arises from the friction requirements, to ensure that a grip sufficient for operation and safety of the elevator exists between the hoisting rope and the traction sheave. On the other hand, it is essential in respect of elevator operation and safety that the rope portion below the elevator car in an elevator solution without counterweight should be kept sufficiently tight. This can not necessarily be achieved using a spring or a simple lever.

BRIEF DESCRIPTION OF THE DRAWINGS

In the following, example embodiments will be described in detail by the aid of a few examples of its embodiments with reference to the attached drawings, wherein.

DETAILED DESCRIPTION OF EXAMPLE EMBODIMENTS

Figure 1:
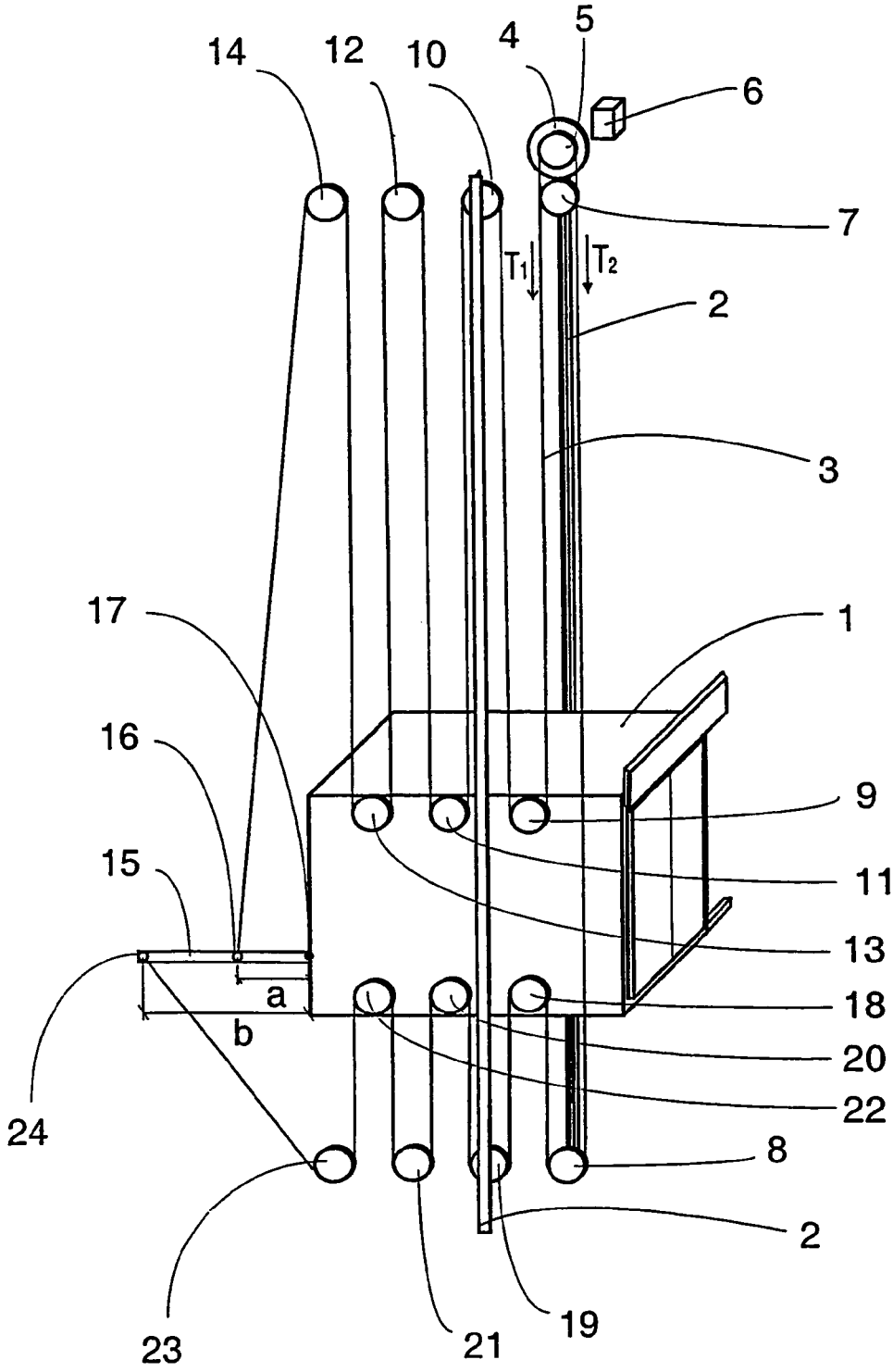
FIG. 1 is a diagram illustrating a traction sheave elevator without counterweight according to example embodiments.

FIG. 1 presents a diagrammatic illustration of the structure of an elevator according to the invention. The elevator is preferably an elevator without machine room, with a drive machine 4 placed in an elevator shaft. The elevator shown in the figure is a traction sheave elevator without counterweight and with machine above. The passage of the hoisting ropes 3 of the elevator is as follows: One end of the ropes is immovably fixed to a fixing point 16 on a lever 15 fastened to the elevator car 1, said fixing point being located at a distance a from the pivot 17 connecting the lever to the elevator car 1. In FIG. 1, the lever 15 is thus pivoted on the elevator car 1 at fixing point 17. From fixing point 16, the hoisting ropes 3 run upwards to a diverting pulley 14 placed in the upper part of the elevator shaft above the elevator car 1, from which diverting pulley the ropes 3 go further downwards to a diverting pulley 13 on the elevator car, and from this diverting pulley 13 the ropes go upwards again to a diverting pulley 12 fitted in the upper part of the shaft above the car. From diverting pulley 12, the ropes go further downwards to a diverting pulley 11 mounted on the elevator car. Having passed around this pulley, the ropes go again upwards to a diverting pulley 10 fitted in the upper part of the shaft, and having passed around this pulley they go downwards again to a diverting pulley 9 fitted on the elevator car. After wrapping around this diverting pulley 9, the hoisting ropes 3 go further upwards to the traction sheave 5 of the drive machine 4 placed in the upper part of the elevator shaft, having previously passed via a diverting pulley 7 with only a "tangential contact" with the ropes. This means that the ropes 3 going from the traction sheave 5 to the elevator car 1 pass via the rope grooves of diverting pulley 7 while the deflection of the rope 3 caused by the diverting pulley 7 is very small. It could be said that the ropes 3 coming from the traction sheave 5 only touch the diverting pulley 7 "tangentially". Such "tangential contact" serves as a solution damping the vibrations of the outgoing ropes and it can be applied in other roping solutions as well. The ropes pass around the traction sheave 5 of the hoisting machine 4 along the rope grooves of the traction sheave 5. From the traction sheave 5, the ropes 3 go further downwards to diverting pulley 7, passing around it along the rope grooves of the diverting pulley 7 and returning back up to the traction sheave 5, over which they pass along the rope grooves of the traction sheave. From the traction sheave 5, the hoisting ropes 3 go further downwards in "tangential contact" with diverting pulley 7 past the elevator car 1 moving along guide rails 2, to a diverting pulley 8 placed in the lower part of the elevator shaft, passing around it along the rope grooves on it. From the diverting pulley 8 in the lower part of the elevator shaft, the ropes go upwards to a diverting pulley 18 on the elevator car, from where the ropes 3 go further to a diverting pulley 19 in the lower part of the elevator shaft and further back up to a diverting pulley 20 on the elevator car, from where the ropes 3 go further downwards to a diverting pulley 21 in the lower part of the shaft, from where they go further to a diverting pulley 22 on the elevator car, from where the ropes 3 go further to a diverting pulley 23 in the lower part of the elevator shaft. From diverting pulley 23, the ropes 3 go further to the lever 15 pivotally fixed to the elevator car 1 at point 17, one end of the ropes 3 being immovably fastened to said lever 15 at point 24 at distance b from the pivot 17. In the case illustrated in FIG. 1, the hoisting machine and the diverting pulleys are preferably all placed on one and the same side of the elevator car. This solution is particularly advantageous in the case of a rucksack-type elevator, in which case the above-mentioned components are disposed behind the elevator car, in the space between the elevator car and the back wall of the shaft. The hoisting machine and the diverting pulleys may also be laid out in other appropriate ways in the elevator shaft. The roping arrangement between the traction sheave 5 and the diverting pulley 7 is referred to as Double Wrap roping, wherein the hoisting ropes are wrapped around the traction sheave two and/or more times. In this way, the contact angle can be increased in two and/or more stages. For example, in the embodiment presented in FIG. 1, a contact angle of 180°+180°, i.e. 360° between the traction sheave 5 and the hoisting ropes 3 is achieved. The Double Wrap roping presented in the figure can also be arranged in another way, e.g. by placing diverting pulley 7 on the side of the traction sheave 5, in which case, as the hoisting ropes pass twice around the traction sheave, a contact angle of 180°+90°, i.e. 270° is achieved, or by placing the traction sheave in some other appropriate location. A preferable solution is to dispose the traction sheave 5 and the diverting pulley 7 in such a way that the diverting pulley 7 will also function as a guide of the hoisting ropes 3 and as a damping pulley. Another advantageous solution is to build a complete unit comprising both an elevator drive machine with a traction sheave and one or more diverting pulleys with bearings in a correct operating angle relative to the traction sheave. The operating angle is determined by the roping used between the traction sheave an the diverting pulley/diverting pulleys, which defines the way in which the mutual positions and angle between the traction sheave and diverting pulley/diverting pulleys relative to each other are fitted in the unit. This unit can be mounted in place as a unitary aggregate in the same way as a drive machine. In a preferred case, the drive machine 4 may be fixed e.g. to a car guide rail, and the diverting pulleys 7,10,12,14 in the upper part of the shaft are mounted on the beams in the upper part of the shaft, which are fastened to the car guide rails 2. The diverting pulleys 9,11,13,18,20,22 on the elevator car are preferably mounted on beams disposed in the upper and lower parts of the car, but they may also be secured to the car in other ways, e.g. by mounting all the diverting pulleys on the same beam. The diverting pulleys 8,19,21,23 in the lower part of the shaft are preferably mounted on the shaft floor. In FIG. 1, the traction sheave engages the rope portion between diverting pulleys 8 and 9, which is a preferable solution according to the invention. In a preferable solution according to the invention, the elevator car 1 is connected to the hoisting ropes 3 by means of at least one diverting pulley from the rim of which the hoisting ropes go upwards from both sides of the diverting pulley, and at least one diverting pulley from the rim of which the hoisting ropes go downwards from both sides of the diverting pulley, and in which elevator the traction sheave 5 engages the portion of the hoisting rope 3 between these diverting pulleys. The roping between the traction sheave 5 and diverting pulley 7 can also be implemented in other ways instead of Double Wrap roping, such as e.g. by using Single Wrap roping, in which case diverting pulley 7 will not necessarily be needed at all, ESW roping (Extended Single Wrap), XW roping (X wrap) or some other appropriate roping solution.

The drive machine 4 placed in the elevator shaft is preferably of a flat construction, in other words, the machine has a small thickness dimension as compared to its width and/or height, or at least the machine is slim enough to be accommodated between the elevator car and a wall of the elevator shaft. The machine may also be placed differently, e.g. by disposing the slim machine partly or completely between an imaginary extension of the elevator car and a shaft wall. In the elevator of the invention, it is possible to use a drive machine 4 of almost any type and design that fits into the space intended for it. For example, it is possible to use a geared or gearless machine. The machine may be of a compact and/or flat size. In the suspension solutions according to the invention, the rope speed is often high as compared to the speed of the elevator, so it is possible to use even unsophisticated machine types as the basic machine solution. The elevator shaft is advantageously provided with equipment required for the supply of power to the motor driving the traction sheave 5 as well as equipment needed for elevator control, both of which can be placed in a common instrument panel 6 or mounted separately from each other or integrated partly or wholly with the drive machine 4. A preferable solution is a gearless machine comprising a permanent magnet motor. The drive machine may be fixed to a wall of the elevator shaft, to the ceiling, to a guide rail or to some other structure, such as a beam or frame. In the case of an elevator with machine below, a further possibility is to mount the machine on the bottom of the elevator shaft. FIG. 1 illustrates a preferred suspension solution in which the suspension ratio of the diverting pulleys above the elevator car and the diverting pulleys below the elevator car is the same 7:1 suspension in both cases. To visualize this ratio in practice, it means the ratio of the distance traveled by the hoisting rope to the distance traveled by the elevator car. The suspension arrangement above the elevator car 1 is implemented by means of diverting pulleys 14,13,12,11,10,9 and the suspension arrangement below the elevator car 1 is implemented by means of diverting pulleys 23,22,21,20,19,18,8. Other suspension solutions can also be used to implement the invention. The elevator of the invention can also be implemented as a solution comprising a machine room, or the machine may be mounted to be movable together with the elevator. In the invention, the diverting pulleys connected to the elevator car may be preferably mounted on one and the same beam. This beam may be fitted on top of the car, on the side of the car or below the car, on the car frame or in some other appropriate place in the car structure. The diverting pulleys may also be fitted each one separately in appropriate places on the car and in the shaft. The diverting pulleys placed above the elevator car in the elevator shaft, preferably in the upper part of the elevator shaft, and/or the diverting pulleys placed below the elevator car in the elevator shaft, preferably in the lower part of the elevator shaft, may also be fitted e.g. on a common anchorage, such as e.g. a beam.

The function of the lever 15 pivoted on the elevator car at point 17 in FIG. 1 is to eliminate rope elongations occurring in the hoisting rope 3. On the other hand, it is essential to the operation and safety of the elevator that a sufficient tension be maintained in the lower rope portion, which refers to that part of the hoisting rope which is below the elevator car. By means of the lever arrangement 15 according to the invention, the tensioning of the hoisting rope and the compensation of rope elongation can be achieved without using a prior-art spring or weight. By means of the lever arrangement 15 of the invention, it is also possible to implement the rope tensioning in such manner that the ratio $T_1/T_2$ between the rope forces $T_1$ and $T_2$ acting in different directions on the traction sheave 5 can be kept at a desired constant value, which may be e.g. 2. In connection with rope forces, we can also speak of rope tensions. This constant ratio can be varied by varying the distances a and b, because $T_1/T_2=b/a$. When odd suspension ratios are used in the suspension of the elevator car, the lever 15 is pivoted on the elevator car, and when even suspension ratios are used, the lever 15 is pivoted on the elevator shaft.

Figure 2:
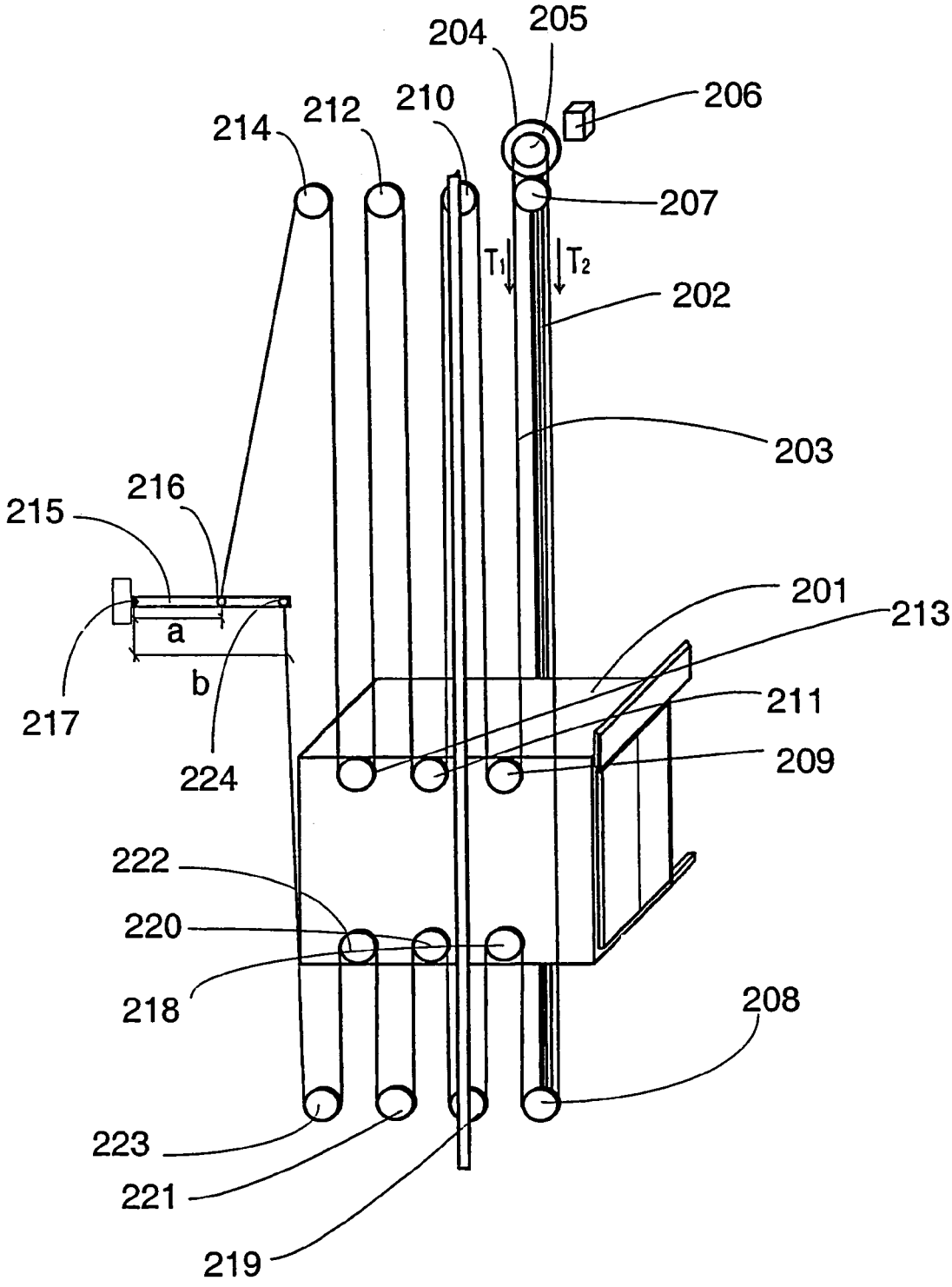
FIG. 2 illustrates a diagram of another traction sheave elevator without counterweight according to example embodiments.

FIG. 2 presents a diagrammatic illustration of the structure of an elevator according to the invention. The elevator is preferably an elevator without machine room, with the drive machine 204 placed in the elevator shaft. The elevator shown in FIG. 2 is a traction sheave elevator with machine above and without counterweight, with an elevator car 201 moving along guide rails 2. The passage of the hoisting ropes 203 in FIG. 2 is similar to that in FIG. 1, but in FIG. 2 there is the difference that the lever 215 is immovably pivoted on a wall of the elevator shaft at point 217. As the lever 215 is pivoted on the elevator shaft, preferably on a wall of the elevator shaft, instead of on the elevator car, this is a case of even suspension ratio both in the rope portion above the elevator car 1 and in the rope portion below it. The suspension above the elevator car comprises the hoisting machine 204 and diverting pulleys 209, 210, 211, 212, 213, 214. The suspension below the elevator car comprises diverting pulleys 208, 218, 219, 220, 221, 222, 223. One end of the hoisting rope is fastened to the lever 215 at point 216, which is at distance 'a' from the pivot 217, while its other end is fastened to the lever 215 at point 224, which is at distance 'b' from the pivot 217. Both in the rope portion above the elevator car and in the rope portion below it, the suspension ratio of the elevator car is 6:1.

Due to a high suspension ratio, the rope length of the hoisting rope used in an elevator without counterweight is large. For example, in an elevator without counterweight suspended with a suspension ratio of 10:1, in which the same suspension ratio 10:1 is used both above and below the elevator car, and which elevator has a hoisting height of 25 meters, the rope length of the hoisting rope is about 270 meters. In this case, as a result of variations in rope stress and/or temperature, the length of the rope may change by as much as about 50 cm. Therefore, the requirements regarding compensation of rope elongation are also greater. For the operation and safety of the elevator, it is essential that the rope below the elevator car be kept under a sufficient tension. This can not always be accomplished by using a spring or a simple lever.

Figure 3:
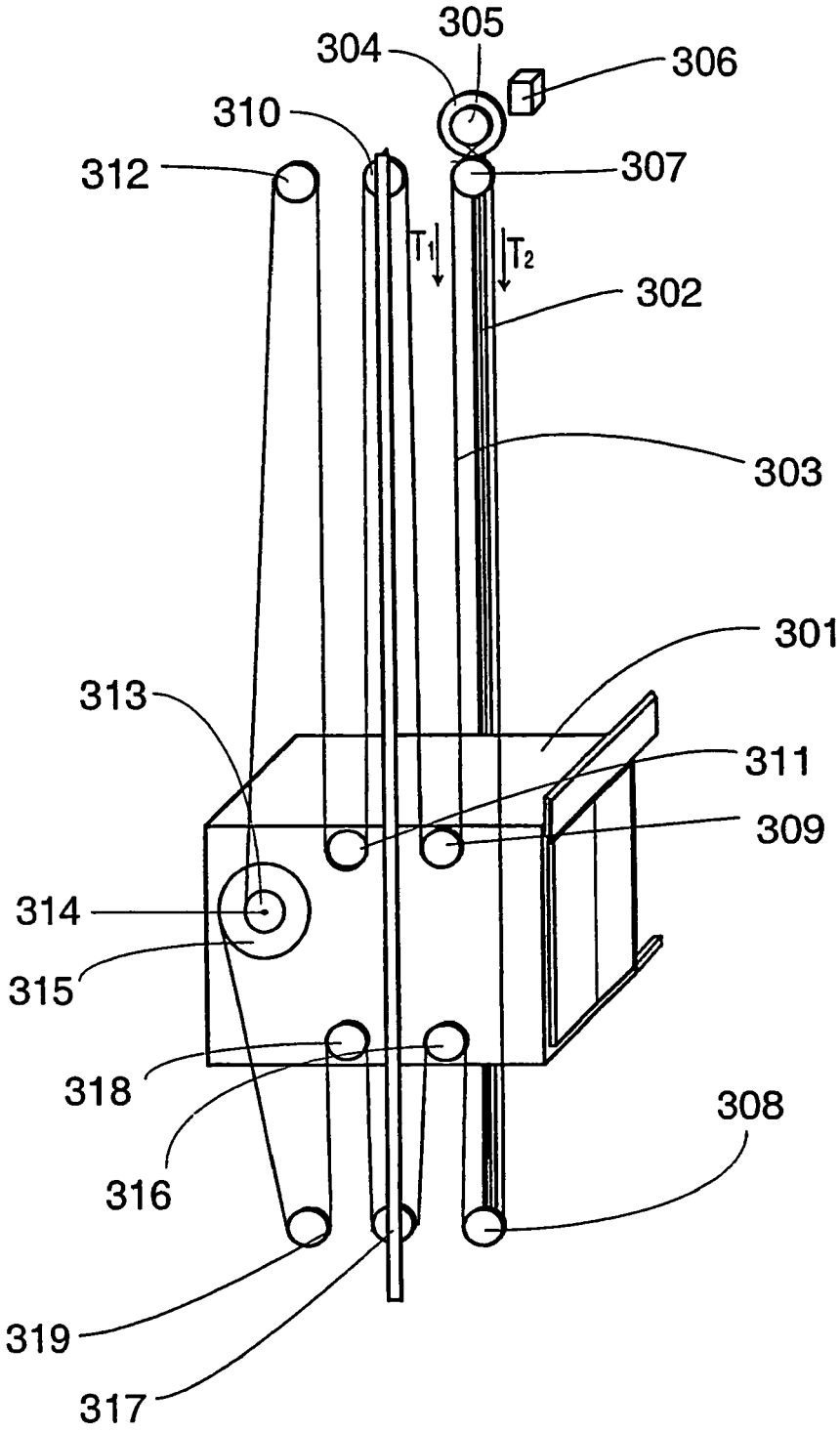
FIG. 3 illustrates a diagram of a third traction sheave elevator without counterweight according to example embodiments.

FIG. 3 presents a diagrammatic illustration of the structure of an elevator according to the invention. The elevator is preferably an elevator without machine room, with the drive machine 304 placed in the elevator shaft. The elevator shown in the figure is a traction sheave elevator with machine above and without counterweight, with an elevator car 301 moving along guide rails 302. In FIG. 3, the lever solution used in FIG. 1 and 2 has been replaced with two sheave-like bodies, preferably sheaves 313 and 315, connected to each other at point 314, where the tensioning sheaves 313,315 are fixedly secured to the elevator car 301. Of the sheave-like bodies, the sheave 315 engaging the hoisting rope portion below the elevator car has a diameter larger than the diameter of the sheave 313 engaging the hoisting rope portion above the elevator car. The diameter ratio between the diameters of the tensioning sheaves 313 and 315 determines the magnitude of the tensioning force acting on the hoisting rope and therefore also the force of compensation of hoisting rope elongations. In this solution, the use of tensioning sheaves provides the advantage that the structure compensates even very large rope elongations. By varying the diametric size of the tensioning sheaves, it is possible to influence the magnitude of the rope elongation to be compensated and the ratio between the rope forces. $T_1$ and $T_2$ acting on the traction sheave, which ratio can be rendered constant by this arrangement. Due to a large suspension ratio or a large hoisting height, the length of the rope used in the elevator is large. For the operation and safety of the elevator, it is essential that the hoisting rope portion below the elevator car be kept under a sufficient tension and that the amount of rope elongation to be compensated be large. Often this can not be implemented using a spring or a simple lever. With odd suspension ratios above and below the elevator car, the tensioning sheaves are immovably fitted in connection with the elevator car, and with even suspension ratios the tensioning sheaves are immovably fitted to the elevator shaft or some other corresponding location which is not fixedly fitted to the elevator car. The solution can be implemented using tensioning sheaves as presented in FIGS. 3 and 4, but the number of sheave-like bodies used may vary; for example, it is possible to use only one sheave with locations fitted for hoisting rope fixing points differing in diameter. It is also possible to use more than two tensioning sheaves e.g. to allow the diameter ratio between the sheaves to be varied by only changing the diameter of the tensioning sheaves.

In FIG. 3, the hoisting ropes run as follows. One end of the hoisting ropes is secured to tensioning sheave 313, which sheave is immovably attached to sheave 315. This set of sheaves 313,315 is fitted to the elevator car at point 314. From sheave 313, the hoisting ropes 303 go upwards and encounter a diverting pulley 312 placed above the elevator car in the elevator car, preferably in the upper part of the elevator shaft, passing around it along rope grooves provided in the diverting pulley 312. These rope grooves may be coated or uncoated, e.g. with friction increasing material, such as polyurethane or some other appropriate material. From pulley 312, the ropes go further downwards to a diverting pulley 311 on the elevator car, and having passed around this pulley, the ropes go further upwards to a diverting pulley 310 fitted in the upper part of the shaft. Having passed around this diverting pulley 310, the rope goes again downwards to a diverting pulley 309 mounted on the elevator car, and having passed around this pulley the hoisting ropes go further upwards to a diverting pulley 307 preferably fitted near the hoisting machine 304. Between diverting pulley 307 and the traction sheave 304, the figure shows X wrap roping, in which roping the hoisting rope runs crosswise with the rope portion going upwards from diverting pulley 307 to the traction sheave 305 and with the rope portion returning from the traction sheave 305 to diverting pulley 307. Pulleys 313,312,311,310,309 together with the hoisting machine form the suspension arrangement above the elevator car, where the suspension ratio is the same as in the suspension arrangement below the elevator car, this suspension ratio being 5:1 in FIG. 3. From diverting pulley 307, the ropes run further to a diverting pulley 308 preferably fitted in place in the lower part of the elevator shaft e.g. on a car guide rail 302 or on the shaft floor or in some other appropriate place. Having passed around diverting pulley 308, the hoisting ropes 303 go further upwards to a diverting pulley 316 fitted in place on the elevator car, pass around this pulley and then go further downwards to a diverting pulley 317 in the lower part of the elevator shaft, passing around it and returning to a diverting pulley 318 fitted in place on the elevator car. Having passed around diverting pulley 318, the hoisting ropes 303 go further downwards to a diverting pulley 319 fitted in place in the lower part of the elevator shaft, passing around it and then going further upwards to the tensioning sheave 315 fitted in place on the elevator car and immovably fitted to tensioning sheave 313.

Figure 4:
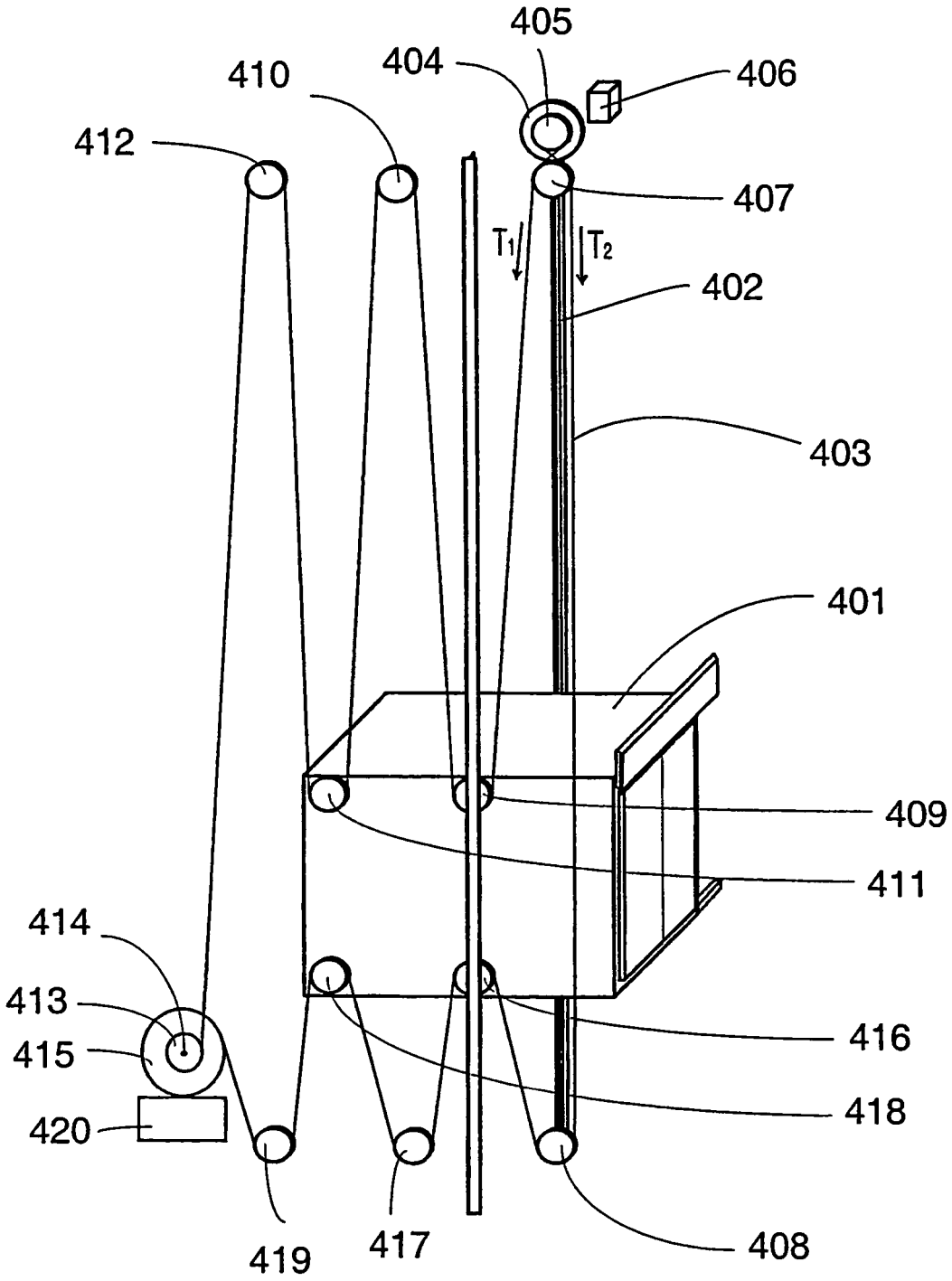
FIG. 4 illustrates a diagram of a fourth traction sheave elevator without counterweight according to example embodiments.

FIG. 4 presents a diagrammatic illustration of the structure of an elevator according to the invention. The elevator is preferably an elevator without machine room, with a drive machine 404 placed in the elevator shaft. The elevator shown in the figure is a traction sheave elevator without counterweight and with machine above, with an elevator car 401 moving along guide rails 402. The passage of the hoisting ropes 403 in FIG. 4 corresponds to that in FIG. 3 with the difference that in FIG. 4 the tensioning sheaves 413,415 are fitted in place in the elevator shaft, preferably on the bottom of the elevator shaft. As the tensioning sheaves 413,415 are fitted in place in the elevator shaft and not in connection with the elevator car, this is a case of even suspension ratio both in the rope portion above the elevator car 1 and in the rope portion below it. In FIG. 4, the suspension ratio is 4:1. The end of the hoisting ropes 403 below the elevator car 401 is fastened to the tensioning sheave 415 with a larger diameter while the end of the hoisting ropes above the elevator car is fastened to the tensioning sheave 413 with a smaller diameter. The tensioning sheaves 413,415 are immovably fitted together and they are secured to the elevator shaft via a mounting piece 420. The suspension above the elevator car comprises the hoisting machine and diverting pulleys 412,411,410,409,407. The suspension below the elevator car comprises diverting pulleys 408,416,417,418,419. A set of tensioning sheaves (415, 413) as illustrated in FIG. 4 used as a compensating system can also be advantageously mounted in place of either diverting pulley 419 at the bottom of the shaft, which pulley is preferably secured to the shaft floor, or diverting pulley 412 in the upper part of the shaft, which pulley is preferably secured to the ceiling of the shaft. In this case, the number of diverting pulleys needed is one less than in the embodiment presented in FIG. 4. Thus, in advantageous cases, installing the elevator is also an easier and faster operation.

Figure 5:
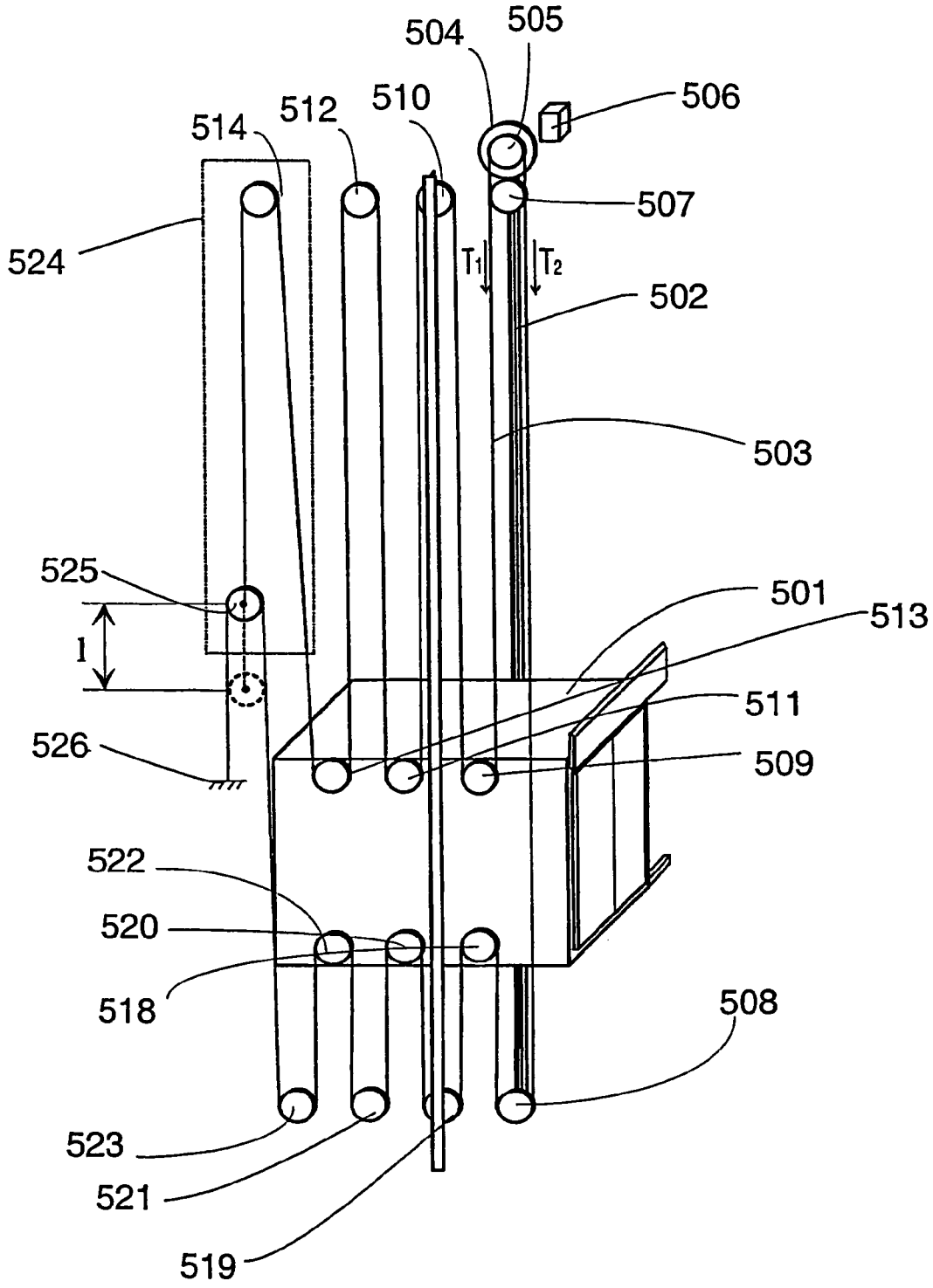
FIG. 5 illustrates a diagram of another traction sheave elevator without counterweight according to example embodiments.

FIG. 5 presents a diagrammatic illustration of the structure of an elevator according to the invention. The elevator is preferably an elevator without machine room, with a drive machine 504 placed in the elevator shaft. The elevator presented in the figure is a traction sheave elevator without counterweight and with machine above, with an elevator car 501 moving along guide rails 502. In elevators with a large hoisting height, the elongation of the hoisting rope involves a need to compensate the rope elongation, which has to be done reliably within certain allowed limit values. Using a set of rope force compensating sheaves 524 according to the invention as presented in FIG. 5, a very long movement is achieved for the compensation of rope elongation. This permits the compensation of even large elongations, which often can not be achieved using simple lever or spring solutions. The compensating sheave arrangement according to the invention presented in FIG. 5 produces a constant ratio $T_1/T_2$ between the rope forces $T_1$ and $T_2$ acting on the traction sheave. In the case illustrated in FIG. 5, the ratio $T_1/T_2$ equals 2/1.

The passage of the hoisting ropes in FIG. 5 is as follows. One end of the hoisting ropes 503 is fastened to diverting pulley 525, which diverting pulley has been fitted to hang on the rope portion coming downwards from diverting pulley 514. Diverting pulleys 514 and 525 together form a rope force compensating system 524, which in the case of FIG. 5 is a set of compensating sheaves. From diverting pulley 514, the hoisting ropes run further as described in connection with the previous figures between diverting pulleys 512,510,507 fitted in place in the upper part of the elevator shaft and diverting pulleys 513,511,509 fitted in place on the elevator car, forming the suspension arrangement above the elevator car. Between the hoisting machine 504 and the traction sheave 505, DW suspension is used, which was already described in detail in connection with FIG. 1. The roping between the diverting pulley 507 and the traction sheave can also be implemented using other appropriate roping solutions, such as e.g. SW, XW or ESW suspension. From the traction sheave, the hoisting ropes go further via diverting pulley 507 to a diverting pulley 508 placed in the lower part of the elevator shaft. Having passed around diverting pulley 508, the hoisting ropes run between diverting pulleys 518,520,522 fitted in place in the lower part of the shaft and diverting pulleys 519,521,523 fitted on the elevator car 501 in the manner described in connection with the previous figures. From diverting pulley 523, the hoisting ropes 503 go further to a diverting pulley 525 comprised in the rope force compensating sheave system 524 and fastened to one end of the hoisting rope. Having passed around diverting pulley 525 along its rope grooves, going further to the anchorage 526 of the other end of the rope in the elevator shaft or in some other appropriate place. The suspension ratio of the elevator car both above and below the elevator car is 6:1.

In the embodiment presented in FIG. 5, the rope force compensating sheave system 524 compensates rope elongations by means of diverting pulley 525. This diverting pulley 525 moves through distance I, compensating elongations of the hoisting ropes 503. The compensating distance I equals half the rope elongation of the hoisting ropes. In addition, this arrangement produces a constant tension across the traction sheave 505, the ratio $T_1/T_2$ between the rope forces being 2/1. The rope force compensating sheave system 524 can also be implemented in other ways besides that described in the example, e.g. by using more complex suspension arrangements with the rope force compensating sheaves, for example by using different suspension ratios between the diverting pulleys in the compensating sheave system.

Figure 6:
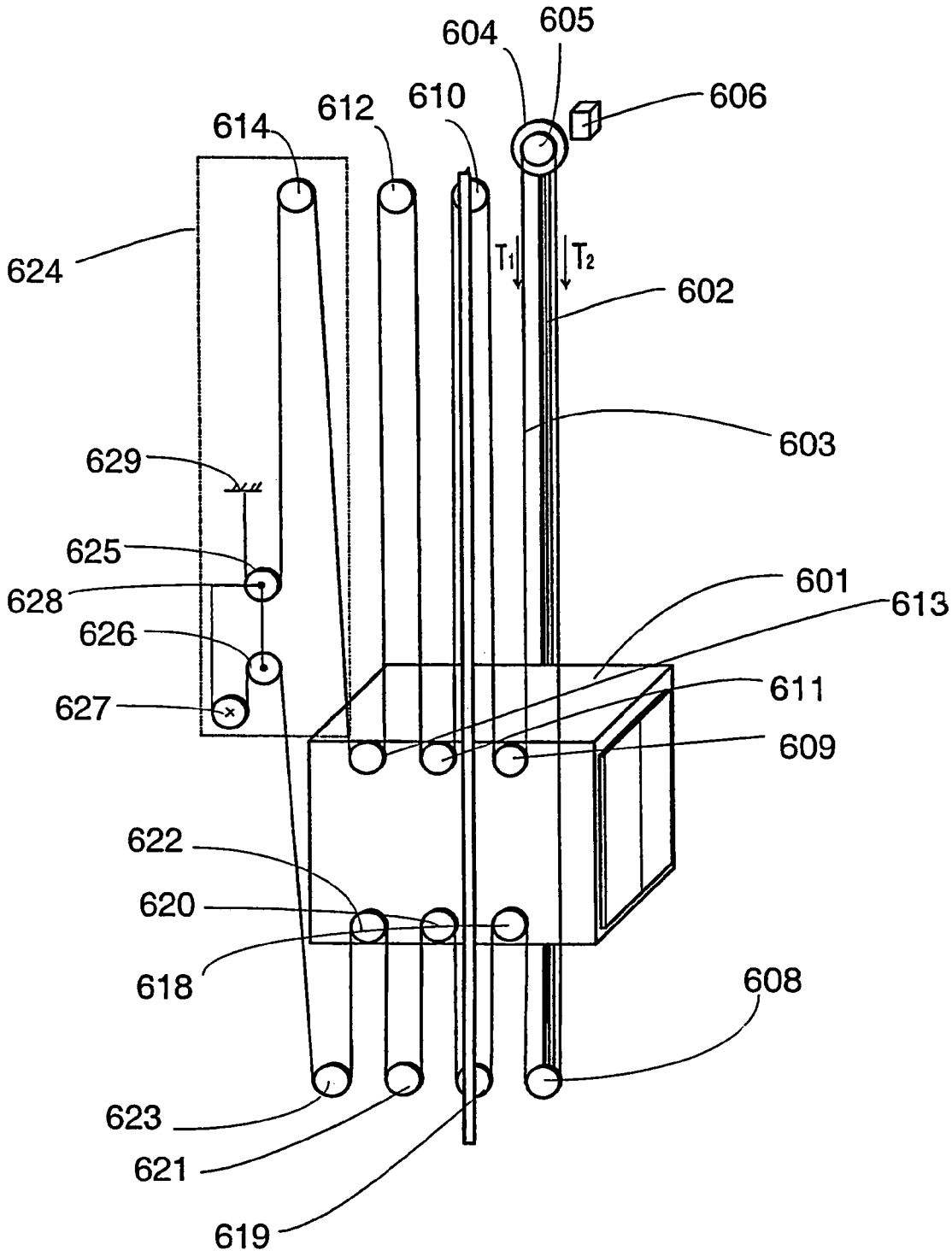
FIG. 6 illustrates a diagram of another traction sheave elevator without counterweight according to example embodiments.

FIG. 6 presents another implementation for the compensation of rope elongations using a compensating device. In FIG. 6, the passage of the ropes and the suspension ratio in the portions above and below the elevator car are identical to those in FIG. 5 as described above. The hoisting ropes 603 run between diverting pulleys 609, 611, 613 mounted on the elevator car and diverting pulleys 610, 612, 614 in the upper part of the elevator shaft and the traction sheave 605 in the manner presented in FIG. 5, and the hoisting ropes 603 go further from the traction sheave 605 to the lower part of the elevator shaft to traction sheave 608, and having passed around it they run further between the diverting pulleys 618, 620, 622 fitted on the elevator car and the diverting pulleys 619, 621, 623 fitted in the lower part of the elevator shaft as described in connection with FIG. 5. The suspension ratio of the elevator car in the portions above and below the elevator car is 6:1. The elevator presented in FIG. 6 differs from the situation illustrated in FIG. 5 in respect of the compensating device 624. FIG. 6 presents a different roping arrangement according to the invention in the set of compensating sheaves 624 of the compensating device. In the set of compensating sheaves, one end 629 of the hoisting ropes 603 is immovably fitted to the elevator shaft, from which point the hoisting ropes 603 go to the diverting pulley 625, pass around it and go further to a diverting pulley 614 possibly fitted in place in the upper part of the elevator shaft, from where they run further in the manner described above to the traction sheave 605. Diverting pulley 625 is fixedly fitted in conjunction with another diverting pulley 626. These diverting pulleys 626, 625 may be placed, e.g., on the same shaft or they may be connected to each other by a bar or in some other appropriate manner. After passing around diverting pulley 623, the portion of the hoisting ropes 603 below the elevator car comes to the diverting pulley 626 of the compensating device 624, this pulley being connected to diverting pulley 625 in the manner described above. Having passed around diverting pulley 626, the hoisting ropes 603 go further to a diverting pulley 627 immovably fitted in place in the shaft and forming part of the compensating system 624. Having passed around the diverting pulley 627, the hoisting ropes 603 go further to an anchorage 628, to which the other end of the hoisting ropes 603 is immovably secured. This anchorage 628 is on diverting pulley 625 or fixedly connected to it. Using this roping arrangement in the compensating device 624, a constant ratio $T_1/T_2=3/2$ between the rope forces $T_1$ and $T_2$ is achieved. Using this roping arrangement, it is possible to implement single wrap ("SW") roping on the traction sheave, in other words, the diverting pulley 507 shown in FIG. 5 is not necessarily needed at all. SW roping can be used on the traction sheave because the illustrated roping arrangement in the compensating device 624 minimizes the required friction force on the traction sheave and permits small rope forces $T_1$ and $T_2$. However, the diverting pulley 507 presented in FIG. 5 can be used if desirable, e.g., to provide a tangential contact with the hoisting ropes as described in connection with the previous figures. In the compensating device 624, the roping and the number of diverting pulleys may also vary in ways other than those described in this FIG. 6. Via the roping suspension ratios in the compensating device 624, the $T_1/T_2$ ratio can be maintained at a desired constant magnitude. In FIG. 6, the compensation of rope elongation is effected by means of diverting pulley 625 and the diverting pulley 626 fixedly fitted to it. The rope elongation compensating distance in the compensating device becomes shorter as the suspension ratio within it becomes greater.

Figure 7:
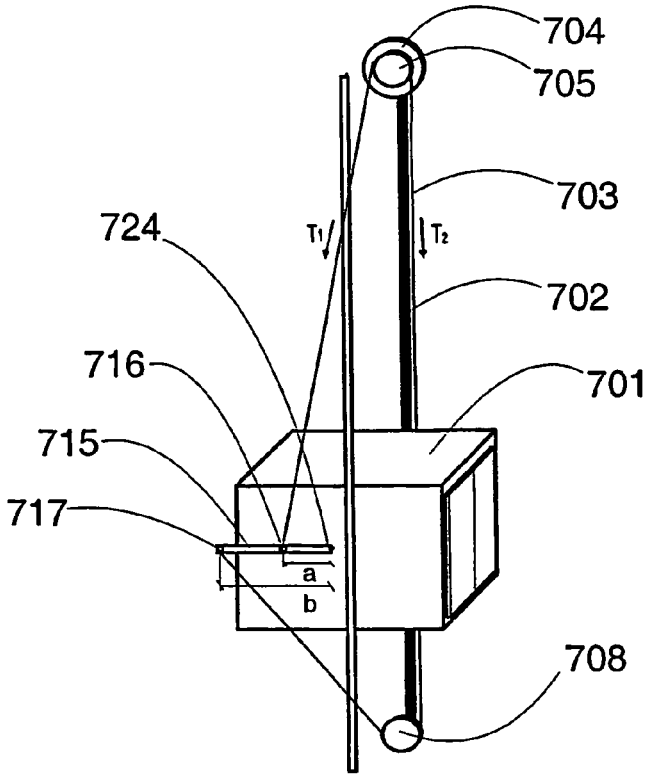
FIG. 7 illustrates a diagram of another traction sheave elevator without counterweight according to example embodiments.

FIG. 7 presents an embodiment of the invention in which the suspension ratio of the roping is 1:1. In the elevator presented in FIG. 7, the compensation of rope elongation is implemented using a lever 715, which lever 715 functions as a rope force compensating device and is immovably pivoted on the elevator car 701. The rope forces are compensated and a constant ratio between the rope forces $T_1$ and $T_2$ is achieved in the manner described in connection with FIG. 1, which yields the $T_1/T_2$ ratio as $T_1/T_2=b/a$, which is independent of the magnitude of the load. The example of an embodiment of the elevator of the invention presented in FIG. 7 can be implemented using e.g. commonly used conventional ropes having a diameter of 8 mm in an elevator for a nominal load of 4 persons, i.e. about 700 kg. In this elevator, the $T_1/T_2$ ratio is 1.5/1 and it uses a traction sheave having a diameter of 320 mm and conventional undercut grooves, and the mass of the elevator car is 700 kg. In this case, the force $T_1$ lifting the elevator car upwards is 1.5 times the force required for lifting the weight of the elevator car and its load, and the force $T_2$ acting downwards on the elevator car is the force required for lifting the weight of the elevator car and the load. This example is not ideal as it leads to an unnecessarily high rope tension relative to the load. By increasing the suspension ratio, it is possible to reduce this rope tension. The elevator of the invention may be provided with a geared machine and it can be constructed e.g. according to FIG. 7 with 1:1 roping.

Figure 8:
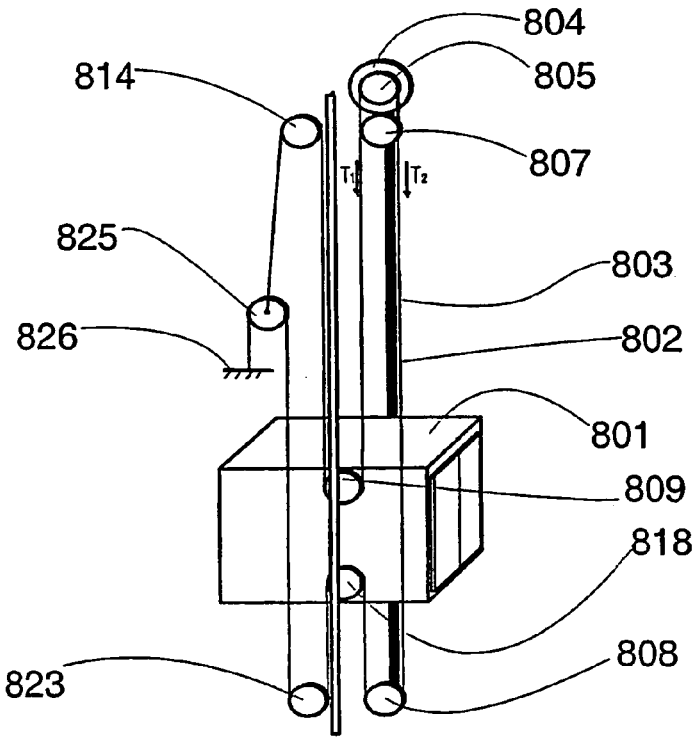
FIG. 8 illustrates a diagram of another traction sheave elevator without counterweight according to example embodiments.

FIG. 8 presents an elevator according to the invention in which a suspension ratio of 2:1 is used in the roping portion 803 of the hoisting ropes above and below the elevator car 801 and DW roping between the traction sheave 805 and the diverting pulley 807. Compensation of rope elongations and constant rope forces are implemented using a rope elongation compensating device as presented in FIG. 5, which produces a rope force ratio of $T_1/T_2=2/1$ while the compensating distance traveled by the diverting pulley 825 equals half the magnitude of the rope elongation.

Figure 9:
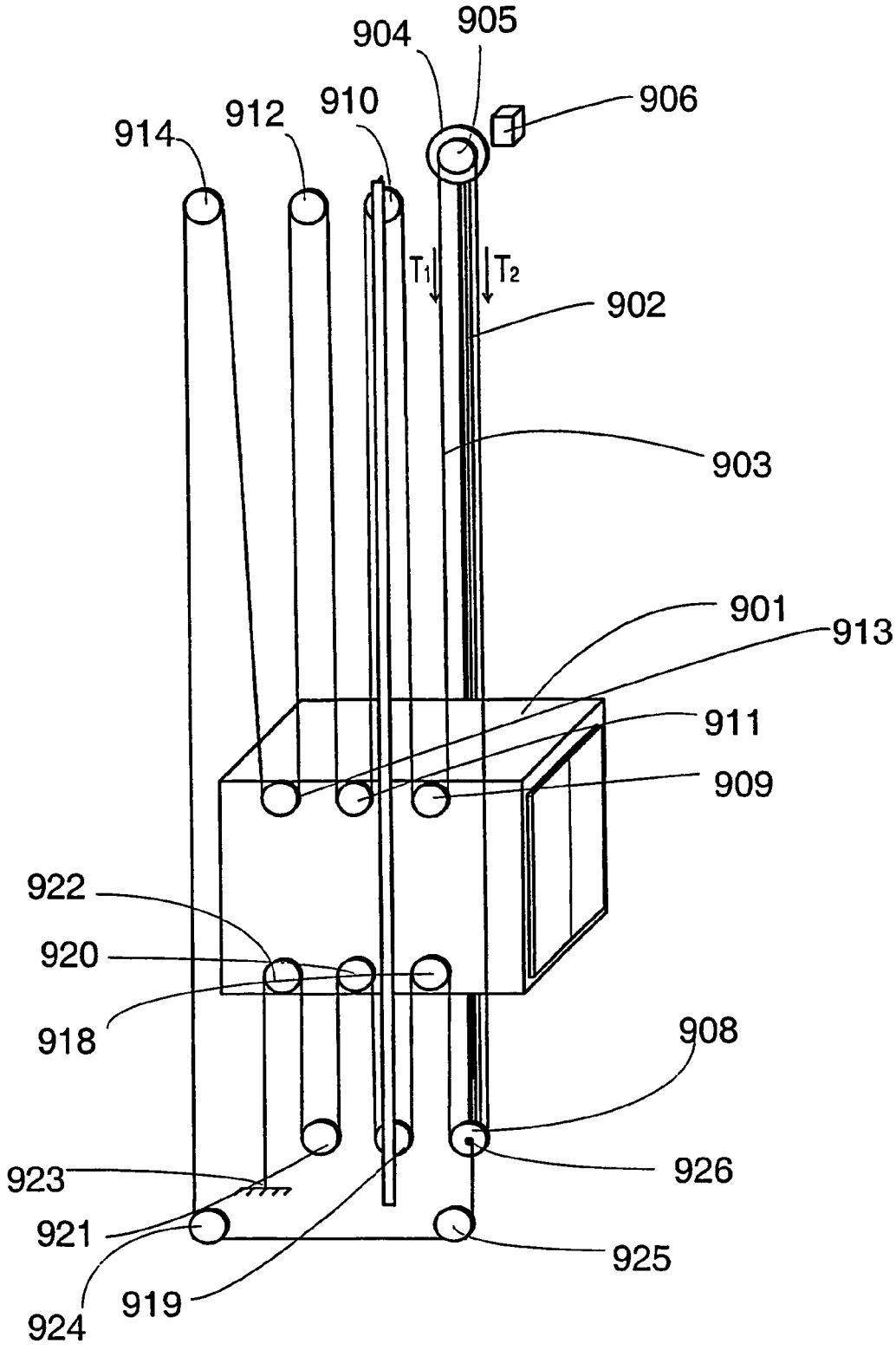
FIG. 9 illustrates a diagram of another traction sheave elevator without counterweight according to example embodiments.

FIG. 9 presents an embodiment of the invention for compensating rope elongations and maintaining a constant rope force ratio. In FIG. 9, the passage of the hoisting ropes 903 is as described above in connection with FIG. 6, where the suspension ratio of the elevator car above and below the elevator car is 6:1. The passage of the hoisting ropes 903 in FIG. 9 differs from the situation shown in FIG. 6 in that the hoisting ropes 903 go downwards from diverting pulley 914 to diverting pulley 924, and also in respect of the compensating system. In addition, one end of the hoisting ropes 903 is immovably fixed to the elevator shaft at point 923 before the hoisting ropes 903 go to diverting pulley 922. In FIG. 9, the compensation of rope elongation is implemented by fastening diverting pulley 908 to the second end of the hoisting ropes 903 at point 926. The elongation of the hoisting ropes 903 is compensated by allowing diverting pulley 908 to move upwards or downwards through a distance equal to half the rope elongation, thus compensating the rope elongation. In the system illustrated in FIG. 9, the compensation of rope elongations and a constant ratio of rope forces are implemented on the same principle as in the situation represented by FIG. 5, where the rope force ratio is $T_1/T_2$ and the compensating distance through which diverting pulley 908 moves equals half the magnitude of the rope elongation. The compensating system presented in FIG. 9 can be implemented using any one of the diverting pulleys 908, 919, 921 in the lower part of the elevator shaft by fastening the second end of the hoisting ropes 903 to the diverting pulley in question, as described above in connection with diverting pulley 908.

When the elevator car is suspended with a small suspension ratio, such as e.g. 1:1, 1:2, 1:3 or 1:4, diverting pulleys of a large diameter and hoisting ropes of a large thickness can be used. Below the elevator car it is possible to use smaller diverting pulleys if necessary, because the tension in the hoisting ropes is lower than in the portion above the elevator car, allowing smaller hoisting rope deflection radiuses to be used. In elevators with a small space below the elevator car, it is advantageous to use diverting pulleys of small diameter in the rope portion below the elevator car. Since by using the rope force compensating system of the invention a constant tension in the hoisting rope portion below the elevator car can be achieved that is smaller by the ratio $T_1/T_2$ than the tension in the rope portion above the elevator car, this makes it possible to reduce the diameters of the diverting pulleys in the rope portion below the elevator car without substantially impairing the service life of the hoisting ropes. For example, the ratio between the diameter D of the diverting pulley to the diameter d of the rope used may be $D/d<40$, and preferably this D/d ratio may be only $D/d=25 \ldots 30$, while the ratio of the diameters of the hoisting rope portion and diverting pulleys above the elevator car is $D/d=40$. The use of diverting pulleys of a smaller diameter allows the space below the elevator car to be reduced to a very small size, which may preferably be only 200 mm.

A preferred embodiment of the elevator of the invention is an elevator without machine room and with machine above, in which the drive machine has a coated traction sheave, and which elevator has thin hoisting ropes of a substantially round cross-section. In the elevator, the contact angle between the hoisting ropes and the traction sheave is greater than 180°. The elevator comprises a unit with a mounting base on which are fitted a drive machine, a traction sheave and a diverting pulley ready fitted at a correct angle relative to the traction sheave. The unit is secured to the elevator guide rails. The elevator is implemented without counterweight with a suspension ratio of 9:1 so that both the roping suspension ratio above the elevator car and the roping suspension ratio below the elevator car is 9:1, and that the roping of the elevator runs in the space between one of the walls of the elevator car and the wall of the elevator shaft. The solution for compensating the rope elongations of the elevator rope comprises a set of compensating sheaves, which creates a constant ratio $T_1/T_2=2:1$ between the forces $T_1$ and $T_2$. With the compensating sheave system used, the required compensating distance equals half the magnitude of the rope elongation.

Another preferred embodiment of the elevator of the invention is an elevator without counterweight in which the suspension ratio above and below the elevator car is 10:1. In this embodiment, conventional elevator hoisting ropes are used, which preferably are ropes of a diameter of 8 mm, and a traction sheave which is made of cast iron at least in the area of the rope grooves. The traction sheave has undercut rope grooves and a diverting pulley is used to adjust the rope contact on the traction sheave to 180° or more. When conventional 8-mm ropes are used, the traction sheave diameter is preferably 340 mm. The diverting pulleys used are large rope sheaves which, when conventional 8-mm hoisting ropes are used, have a diameter of 320,330,340 mm or even more. The rope forces are kept constant so that the ratio $T_1/T_2$ between them is 3/2.

Figure 10A:
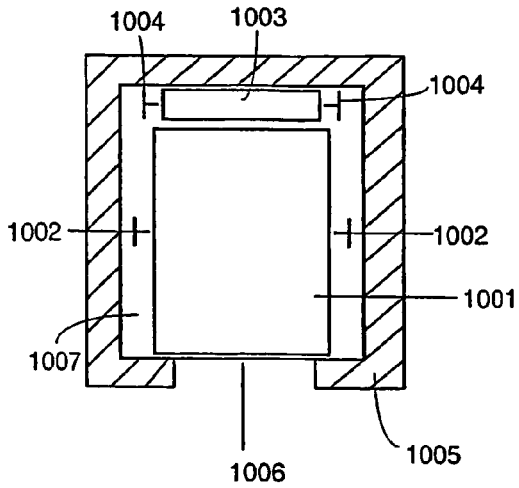
FIGS. 10*a*-10*f* illustrate solutions in which an earlier elevator layout has been replaced with a solution according to example embodiments.
Figure 10B:
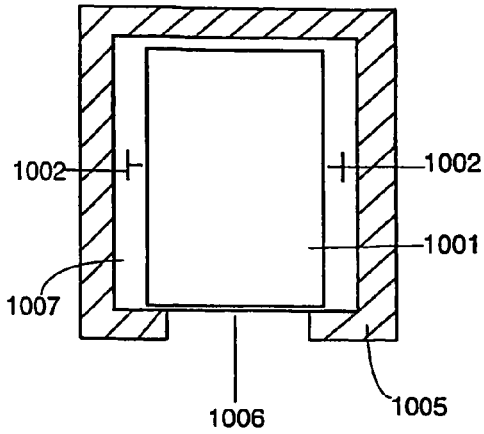

FIG. 10*a* and 10*b* present another example situation, in which a roped elevator with counterweight as shown in FIG. 10*a* has been replaced with or modernized into a roped elevator without counterweight according to the invention as presented in FIG. 10*b*. The elevator presented in FIG. 10*a* is a roped elevator with a counterweight 1003, in which elevator the counterweight 1003 and the counterweight guide rails 1004 are placed, as seen from the door opening 1006, behind the elevator car 1001 moving along guide rails 1002, in the elevator shaft 1007 in the space between the elevator car 1001 and the shaft wall 1005. FIG. 10*b* shows how the space required by the counterweight 1003 and its guide rails 1004 has been eliminated in the elevator shaft 1007 and how the space thus freed up can be utilized for the elevator car 1001 if necessary. This provides the possibility to install a larger elevator car in the same shaft. In the case of a conventional passenger elevator as illustrated in FIG. 10*b*, it is possible to obtain e.g. about 20-25 cm or even more of additional car depth when the elevator presented in FIG. 10*a* is replaced with or modernized into an elevator without counterweight as shown in FIG. 10*b*.

Figure 10C:
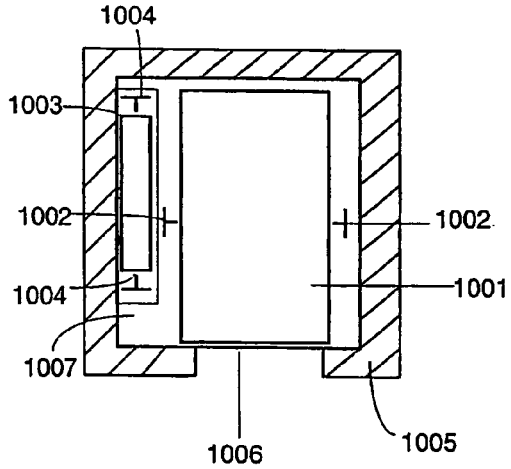
Figure 10D:
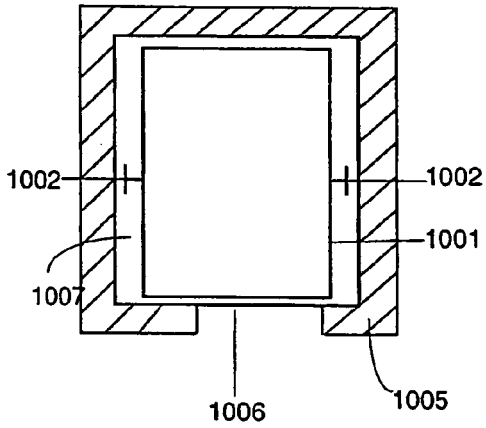

FIG. 10*c* and 10*d* present another example situation, in which a roped elevator with counterweight as shown in FIG. 10*c* has been replaced with or modernized into a roped elevator without counterweight according to the invention as presented in FIG. 10*d*. in the roped elevator with counterweight presented in FIG. 10*a*, the counterweight 1003 and its guide rails 1004 are placed on one side of the elevator car 1001 as seen from the door opening 1006. FIG. 10*d* shows how, according to the invention, the elevator in FIG. 10*c* has been replaced with or modernized into a roped elevator without counterweight according to the invention. The space freed up in the elevator shaft 1007 by removing the counterweight 1003 and its guide rails 1004 can be utilized for the elevator car 1001, allowing the width of the elevator car 1001 to be increased. In the case of a conventional passenger elevator as illustrated in FIG. 10*d*, it is possible to obtain e.g. about 10-20 cm or even more of additional car width when the elevator presented in FIG. 10*c* is replaced with or modernized into an elevator without counterweight as shown in FIG. 10*d*.

Figure 10E:
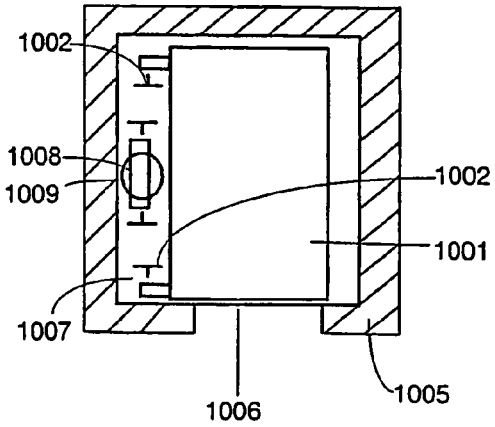
Figure 10F:
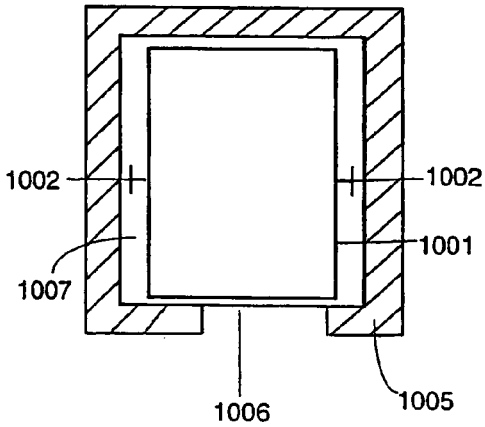
Figure 11:
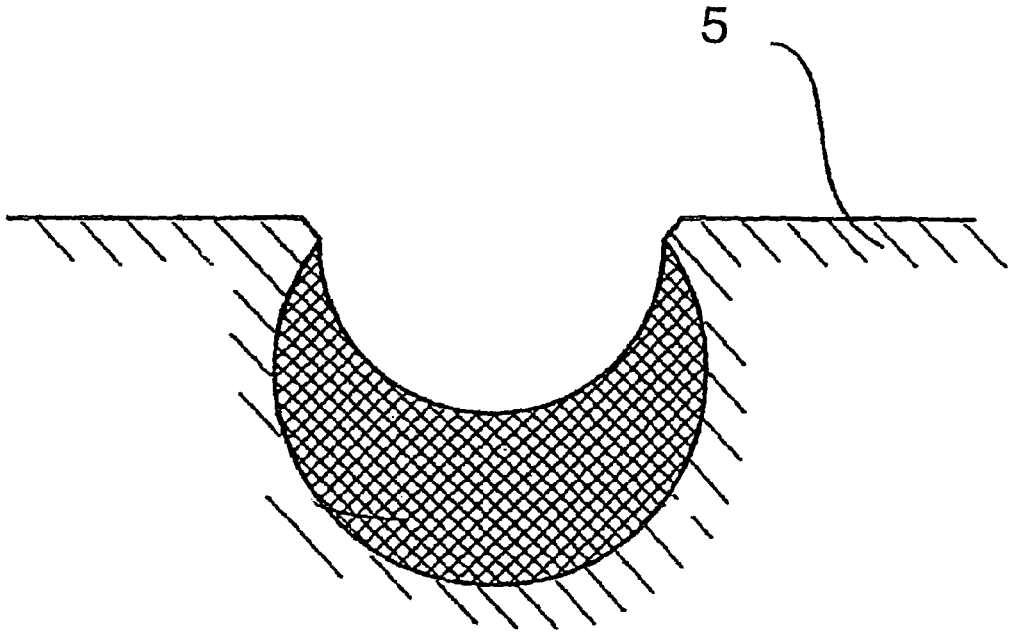
FIG. 11 illustrates a diagram of a coated traction sheave elevator without counterweight according to example embodiments.
Figure 12:
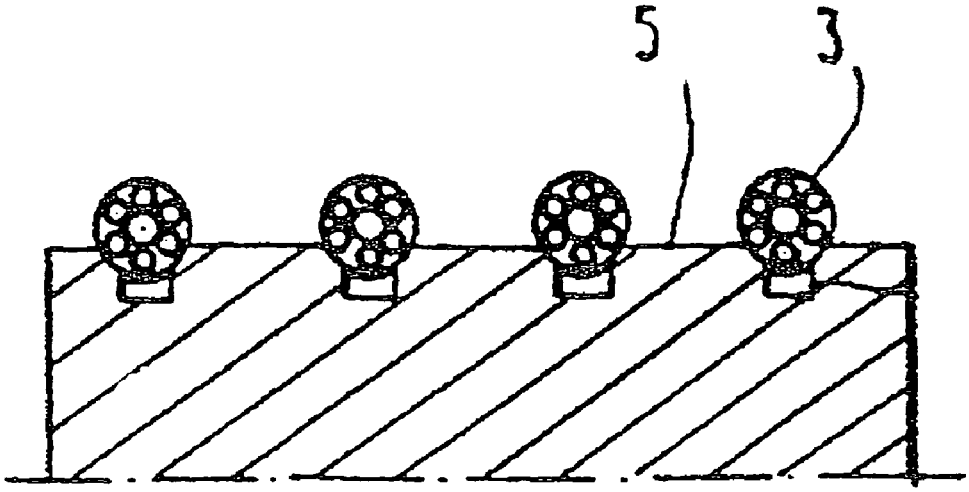
FIG. 12 illustrates a diagram of a traction sheave elevator with rope grooves according to example embodiments.

FIG. 10*e* and 10*f* present a third example situation, in which a side-lifting hydraulic elevator as shown in FIG. 10*e* has been replaced with or modernized into an elevator without counterweight according to the invention as presented in FIG. 10*f*. The hydraulic elevator in FIG. 10*e* comprises a hydraulic cylinder 1009 belonging to the hydraulic lifting apparatus, a diverting pulley 1008 comprised in the hoisting rope system, and its possible guide rails are placed on one side on the elevator car 1001 as seen from the door opening 1006. In the situation illustrated in FIG. 10*e*, the elevator car 1001 is hoisted along guide rails 1002 from one side on the elevator car, but the hoisting function may also be implemented in other ways. The hydraulic lifting function to be replaced or modernized may also consist of a system with lifting force applied from below the elevator car. FIG. 10*f* illustrates how, according to the invention, the elevator in FIG. 10*e* is replaced with or modernized into a roped elevator without counterweight according to the invention. The space freed up in the elevator shaft 1007 by removing the hydraulic lifting apparatus and a possible counterweight can be utilized for the elevator car 1001, allowing the width of the elevator car 1001 to be increased. In the case of a conventional passenger elevator as illustrated in FIG. 10*f*, it is possible to obtain e.g. about 5-15 cm or even more of additional car width when the elevator presented in FIG. 10*e* replaced with or modernized into an elevator without counterweight as shown in FIG. 10*f*.

It is obvious to the person skilled in the art that different embodiments of the invention are not limited to the examples described above, but that they may be varied within the scope of the claims presented below. For instance, the number of times the hoisting ropes are passed between the upper part of the elevator shaft and the elevator car and between the elevator car and the diverting pulleys below it is not a very decisive question as regards the basic advantages of the invention, although it is possible to achieve some additional advantages by using multiple rope passages. In general, applications are so implemented that the ropes go to the elevator car from above as many times as from below, so that the suspension ratios of diverting pulleys going upwards and diverting pulleys going downwards are the same. It is also obvious that the hoisting ropes need not necessarily be passed under the car. In accordance with the examples described above, the skilled person can vary the embodiment of the invention, while the traction sheaves and rope pulleys, instead of being coated metal pulleys, may also be uncoated metal pulleys or uncoated pulleys made of some other material suited to the purpose.

It is further obvious to the person skilled in the art that the traction sheaves and rope pulleys of metallic or some other appropriate material that are used in the invention, functioning as diverting pulleys and coated with a non-metallic material at least in the area of their grooves, may have a coating made of e.g. rubber, polyurethane or some other material suited to the purpose.

It is also obvious to the person skilled in the art that the elevator car and the machine unit may be laid out in the cross-section of the elevator shaft in a manner differing from the lay-out described in the examples. Such a different lay-out might be e.g. one in which the machine is located behind the car as seen from the shaft door and the ropes are passed under the car diagonally relative to the bottom of the car. Passing the ropes under the car in a diagonal or otherwise oblique direction relative to the form of the bottom provides an advantage when the suspension of the car on the ropes is to be made symmetrical relative to the center of mass of the elevator in other types of suspension lay-out as well.

It is further obvious to the person skilled in the art that the equipment required for the supply of power to the motor and the equipment needed for elevator control can be placed elsewhere than in connection with the machine unit, e.g. in a separate instrument panel, or equipment needed for control can be implemented as separate units which can be disposed in different places in the elevator shaft and/or in other parts of the building. It is likewise obvious to the skilled person that an elevator applying the invention may be equipped differently from the examples described above. It is further obvious to the skilled person that the elevator of the invention can be implemented using almost any type of flexible hoisting means as hoisting ropes, e.g. flexible rope of one or more strands, flat belt, cogged belt, trapezoidal belt or some other type of belt applicable to the purpose. It is likewise obvious to the skilled person that the replacement or modernization according to the invention of an elevator with a traction sheave elevator without counterweight according to the invention can also be implemented in the case of drum elevators, screw-driven elevators or elevators having a hoisting function based on almost any other technique.

It is also obvious to the skilled person that, instead of using ropes with a filler, the invention may be implemented using ropes without filler, which are either lubricated or unlubricated. In addition, it is also obvious to the person skilled in the art that the ropes may be twisted in many different ways.

It is also obvious to the person skilled in the art that the elevator of the invention can be implemented using different roping arrangements between the traction sheave and the diverting pulley/diverting pulleys to increase the contact angle $\alpha$ than those described as examples. For example, it is possible to dispose the diverting pulley/diverting pulleys, the traction sheave and the hoisting ropes in other ways than in the roping arrangements described in the examples. It is also obvious to the skilled person that, in the elevator of the invention, the elevator may also be provided with a counterweight, in which case the counterweight has e.g. a weight below that of the car and is suspended by a separate roping arrangement.

Due to the bearing resistance of the rope pulleys used as diverting pulleys and to the friction between the ropes and the rope sheaves and possible losses occurring in the compensating system, the ratio between the rope tensions may deviate somewhat from the nominal ratio of the compensating system. Even a deviation of 5% will not involve any significant disadvantage because in any case the elevator must have a certain inbuilt robustness.

The invention claimed is:

1. An elevator, comprising:
an elevator car;
two or more first diverting pulleys on the elevator car;
two or more second diverting pulleys on the elevator car;
one or more hoisting ropes;
a traction sheave; and
a compensating device;
wherein the elevator car is suspended by the one or more hoisting ropes interacting with the two or more first diverting pulleys and the two or more second diverting pulleys,
wherein the traction sheave moves the elevator car using the one or more hoisting ropes,
wherein the one or more hoisting ropes include first, second, third, and fourth rope portions,
wherein the first rope portions extend upward from both sides of at least one of the two or more first diverting pulleys,
wherein the second rope portions extend downward from both sides of at least one of the two or more second diverting pulleys,
wherein the first rope portions are under a first rope tension caused by the compensating device acting on the third rope portion,
wherein the second rope portions are under a second rope tension caused by the compensating device acting on the fourth rope portion,
wherein the first rope tension is greater than the second rope tension,
wherein a ratio of the first rope tension to the second rope tension is maintained at a substantially constant value, and
wherein the ratio of the first rope tension to the second rope tension is independent of a load of the elevator.

2. The elevator of claim 1, wherein the elevator is an elevator without counterweight.

3. The elevator of claim 1, wherein the compensating device is at least one of a lever, tensioning sheaves, and compensating sheaves.

4. The elevator of claim 1, wherein the compensating device comprises one or more third diverting pulleys.

5. The elevator of claim 1, wherein a continuous contact angle between the traction sheave and the one or more hoisting ropes is at least 180°.

6. The elevator of claim 1, wherein the one or more hoisting ropes include a plurality of wires, and
wherein the wires have a strength greater than about 2000 $N/mm^2$.

7. The elevator of claim 1, wherein the one or more hoisting ropes have, diameters less than 8 mm.

8. The elevator of claim 1, further comprising:
a hosting machine;
wherein the hoisting machine is lighter in weight than a nominal load of the elevator.

9. The elevator of claim 1, wherein the traction sheave is coated with at least one of a polyurethane, a rubber, and some other frictional material suited to the purpose.

10. The elevator of claim 1, wherein the traction sheave, at least in an area of rope grooves, is made of metal.

11. The elevator of claim 1, further comprising:
a plurality of fourth diverting pulleys below the elevator car;
wherein a D/d ratio of the fourth diverting pulleys is less than 40:1,
wherein D is a diameter of the fourth diverting pulleys, and
wherein d is a diameter of the one or more hoisting ropes.

12. A method for forming an elevator, in place of an earlier elevator mounted in an elevator shaft or by making modifications to the earlier elevator, the method comprising:
replacing a hoisting function of the earlier elevator with a hoisting function of the elevator;
providing one or more hoisting ropes; and
arranging a traction sheave to move an elevator car of the elevator using the one or more hoisting ropes;
wherein the elevator car is suspended by the one or more hoisting ropes interacting with two or more first diverting pulleys on the elevator car and two or more second diverting pulleys on the elevator car,
wherein the one or more hoisting ropes include first, second, third, and fourth rope portions,
wherein the first rope portions extend upward from both sides of at least one of the two or more first diverting pulleys,
wherein the second rope portions extend downward from both sides of at least one of the two or more second diverting pulleys,
wherein the first rope portions are under a first rope tension caused by a compensating device of the elevator acting on the third rope portion,
wherein the second rope portions are under a second rope tension caused by the compensating device acting on the fourth rope portion,
wherein the compensating device maintains a substantially constant ratio of the first rope tension to the second rope tension, and
wherein the ratio of the first rope tension to the second rope tension is independent of a load of the elevator.

13. The method of claim 12, wherein the hoisting function of the formed elevator replaces a hydraulic hoisting function of the earlier elevator.

14. The method of claim 12, wherein the hoisting function of the formed elevator replaces a traction-sheave-operated hoisting function, including a counterweight, of the earlier elevator.

15. The method of claim 12, wherein the hoisting function of the formed elevator replaces a hoisting function, having at least one of a drum, a screw, and another corresponding hoisting function, of the earlier elevator.

16. The method of claim 12, wherein equipment included in the hoisting function of the earlier elevator is removed from the elevator shaft.

17. The method of claim 12, wherein an elevator car of the formed elevator has a size larger than the elevator car of the earlier elevator.

18. The elevator of claim 1, wherein the one or more hoisting ropes have diameters greater than or equal to about 3 mm and less than or equal to about 5 mm.

19. The elevator of claim 1, wherein the traction sheave, at least in an area of rope grooves, is made of cast iron.

20. The elevator of claim 10, wherein the traction sheave has undercut rope grooves.

21. The elevator of claim 1, further comprising:

two or more fifth diverting pulleys in an upper portion of an elevator shaft of the elevator;

wherein the first rope portions extend upward from both sides of the at least one of the two or more first diverting pulleys to the two or more fifth diverting pulleys.

22. The elevator of claim 1, further comprising:

two or more fourth diverting pulleys in a lower portion of an elevator shaft of the elevator;

wherein the second rope portions extend downward from both sides of the at least one of the two or more second diverting pulleys to the two or more fourth diverting pulleys.

23. The elevator of claim 1, further comprising:

two or more fifth diverting pulleys in an upper portion of an elevator shaft of the elevator; and two or more fourth diverting pulleys in a lower portion of the elevator shaft;

wherein the first rope portions extend upward from both sides of the at least one of the two or first more diverting pulleys to the two or more fifth diverting pulleys, and wherein the second rope portions extend downward from both sides of the at least one of the two or more second diverting pulleys to the two or more fourth diverting pulleys.

* * * * *